United States Patent [19]

Fukuhara et al.

[11] 4,237,108

[45] Dec. 2, 1980

[54] PROCESS FOR PRODUCING CARBON FABRIC

[75] Inventors: Mototada Fukuhara; Ken-ichi Morita, both of Ehime, Japan

[73] Assignee: Toray Industries, Inc., Tokyo, Japan

[21] Appl. No.: 82,527

[22] Filed: Oct. 9, 1979

Related U.S. Application Data

[63] Continuation of Ser. No. 834,308, Sep. 19, 1977, abandoned.

[30] Foreign Application Priority Data

Dec. 9, 1976 [GB] United Kingdom ..... 51434/76

[51] Int. Cl.[3] ..... D01F 9/12

[52] U.S. Cl. ..... 423/447.4; 264/29.2; 423/447.1; 423/447.6; 423/447.7

[58] Field of Search ..... 423/447.1, 447.2, 447.4, 423/447.6, 447.7, 447.8; 264/29.2

[56] References Cited

U.S. PATENT DOCUMENTS

| | | | |
|---|---|---|---|
| 3,285,696 | 11/1966 | Tsunoda | 423/447.6 |
| 3,541,582 | 11/1970 | Johnson et al. | 423/447.6 |
| 3,775,520 | 11/1973 | Ram et al. | 423/447.6 |
| 3,779,789 | 12/1973 | Park | 156/327 X |
| 3,803,672 | 4/1974 | McGuffin et al. | 26/68 |
| 3,914,960 | 10/1975 | McGuffin et al. | 423/447.6 |
| 3,945,093 | 3/1976 | Larsen et al. | 423/447.4 X |
| 3,961,888 | 6/1976 | Riggs | 423/447.6 |
| 4,069,297 | 1/1978 | Saito et al. | 423/447.6 |

FOREIGN PATENT DOCUMENTS

| | | | |
|---|---|---|---|
| 2053471 | 5/1971 | Fed. Rep. of Germany | 423/447.6 |
| 2211639 | 9/1973 | Fed. Rep. of Germany | 423/447.6 |
| 47-32146 | 8/1972 | Japan . | |
| 47-32147 | 8/1972 | Japan . | |
| 48-42811 | 12/1973 | Japan . | |

*Primary Examiner*—Edward J. Meros

*Attorney, Agent, or Firm*—Finnegan, Henderson, Farabow, Garrett & Dunner

[57] ABSTRACT

A process for producing a carbon fabric wherein a fabric, which is made of an acrylonitrile polymer fiber having a fusing temperature ($T_f$) of at least 310° C. and exhibits a free areal shrinkage of not larger than 50%, is heated in an active gas atmosphere under conditions such that shrinkage of the fabric is permitted, thereby to be stablized, and then, the fabric is carbonized in an inactive gas atmosphere.

10 Claims, No Drawings

PROCESS FOR PRODUCING CARBON FABRIC

This is a continuation of application Ser. No. 834,308 filed Sept. 19 1977, now abandoned.

This invention relates to a process for producing a carbon fabric of improved tenacity and modulus of elasticity from a acrylonitrile polymer fiber.

In general, a carbon fabric may be manufactured by a process wherein an acrylonitrile polymer continuous filament or tow precursor is heated at a temperature of from 200° to 400° C. in an active gas atmosphere thereby to be stabilized; the heat-treated filament or tow is carbonized at a temperature of at least 1,000° C. in an inactive gas atmosphere; and finally, the carbonized filament or tow is woven into a fabric. However, as is well-known, carbon filaments are inherently rigid and brittle. Hence, it is difficult to weave or knit carbon filaments into fabrics by using a conventional weaving or knitting machine for producing fabrics intended for apparel.

It has also been proposed to produce a carbon fabric by carbonizing a precursor fabric. Although this proposed technique is noteworthy from the standpoints of productivity and cost of production, this technique involves the problem that it is difficult to apply a desired degree of uniform tension to a fabric during heat treatment; therefore, carbon fibers thus treated exhibit poor mechanical properties such as poor tenacity and modulus of elasticity.

In order to solve the above-mentioned problems to some extent, it has been proposed to weave or knit a heat-treated filament into a fabric and then to carbonize the fabric. This combined technique is, however, also not satisfactory because the heat-treated filament does not exhibit good mechanical properties. Consequently, it would be difficult to make a fabric from such filaments by using a conventional machine.

A main object of the present invention is to provide a process whereby a carbon fabric having good mechanical properties such as tenacity and modulus of elasticity is advantageously produced. According to such process of the present invention, particularly in the step of heat-treating a fabric in an active gas atmosphere, the above-mentioned problems do not occur.

Other objects and advantages of the present invention will be apparent from the following description.

In accordance with the present invention, there is provided a process for producing a carbon fabric comprising the steps of:

heating a fabric, which is made of an acrylonitrile polymer fiber having a fusing temperature (hereinafter defined and referred to as "$T_f$" for brevity) of at least 310° C. and exhibits a free areal shrinkage of not greater than 50%, in an active gas atmopshere under conditions such that shrinkage of the fabric is permitted, and then, carbonizing the fabric in an inactive gas atmosphere.

The fabric used as a precursor in the process of the invention is comprised of an acrylonitrile polymer fiber having a $T_f$ of at least 310 ° C., preferably 315° to 380° C. and more preferably 320° to 350° C.

By the term "$T_f$ (fusing temperature)" used herein is meant the temperature determined as follows.

A bundle comprised of 20 to 30 filaments is made into a double loop which has a peripheral length of about six times the distance between the two hooks of a metal wire frame. This double loop is placed around the two hooks of the metal wire frame, and ends of the bundle are tied to the frame with a fine metal wire. Then, the metal wire frame together with the double loop of filaments is placed into an oven maintained at a given temperature. After about five seconds, the metal wire frame is taken out from the oven and the bundle of filaments is checked to see if the filaments are broken or not. If the filaments are found to be unbroken, the above procedure is repeated at increasing temperatures until broken filaments are obtained. The final temperature at which the filaments are found to be broken is considered to be the "$T_f$" on the lowest fusing temperature.

A fabric made from an acrylonitrile polymer fiber having a $T_f$ of lower than 310° C. is liable to possess a large areal shrinkage; hence, upon the heat treatment of the fabric in an active gas atmosphere, the molecular configuration of the polymers tends to be greatly disordered, thus resulting in a carbonized fabric with a poor tenacity and modulus of elasticity. In contrast, when the $T_f$ is excessively high, e.g., above approximately 380° C., the acrylonitrile polymer fiber exhibits poor flexibility and flexural fatigue endurance; hence, it is rather difficult to weave or knit the fiber by using a conventional loom or knitting machine. In addition, the resulting fabric is not uniform in its weave construction.

The acrylonitrile polymer fiber having a $T_f$ of at least 310° C. may be prepared as follows.

The acrylonitrile polymer used should preferably be a copolymer comprised of, based on the weight of the copolymer, at least 94% by weight, more preferably at least 97% by weight of acrylonitrile, and not more than 6% by weight, more preferably not more than 3% by weight of copolymerizable monoethylenically unsaturated monomer which is capable of accelerating the heat stabilization reaction. Such copolymerizable monomers include, for example, acrylic acid, methacrylic acid, itaconic acid and salts of these acids such as alkali metal salts and ammonium salt, and 2-(1-hydroxyethyl) acrylonitrile and hydroxyethyl acrylate.

In addition to these heat stabilization reaction-accelerating comonomers, other copolymerizable monoethylenically unsaturated monomers may be used, provided that the total amount of the comonomers other than acrylonitrile is not more than 6% by weight of the copolymer. For example, for the purpose of improving the spinnability and the filament-forming property of the polymer, lower alkyl esters of acrylic acid and methacrylic acid, and sulfonic acid group-containing monomer such as allylsulfonic acid, methallylsulfonic acid and styrenesulfonic acid, acrylic amide, methacrylic amide, vinyl acetate and vinyl chloride may be used. When the amount of the comonomers other than acrylonitrile exceeds 6% by weight, the resulting polymer is liable to have poor packing and poor crystallinity thus leading to a reduction in the $T_f$ and to an increase in shrinkage of the fibers.

The acrylonitrile polymer should preferably possess an intrinsic viscosity of at least 1.4, more preferably within the range of 1.4 to 2.3, as determined at 25° C. on a 150 mg/50 ml polymer solution in dimethylformamide. It is difficult to obtain fibers having a $T_f$ of at least 310° C. from a low molecular weight polymer having an intrinsic viscosity of below 1.4 In contrast, when the intrinsic viscosity is excessively high, the polymer exhibits poor filament-forming property.

The procedure for preparing the acrylonitrile polymer does not have to be of a specific type. Conventional polymerization procedures, for example, solution, suspension and emulsion polymerization procedures, may be employed for this purpose.

The acrylonitrile polymer may be spun into fibers by using conventional wet, dry or half wet spinning procedures. For example, a wet spinning procedure may be employed wherein a spinning dope of the acrylonitrile polymer is extruded through orifices of a spinneret into a coagulating bath, and the filaments so formed are subjected to primary drawing, washing with water, drying for densifying the filaments, secondary drawing and then heat treatment. However, in this wet spinning procedure, the washing with water should be carried out to an extent such that the amount of the residual solvent in the fiber is not larger than approximately 0.1% by weight based on the dry weight of the fiber. This is because the residual solvent functions as a plasticizer and, hence, lowers the $T_f$ of the fibers. Furthermore, the drawing should preferably be carried out to an extent such that the total drawing ratio in the drawing steps is at least six times the original length of the fiber in order to obtain a dimensionally stable fiber having high crystallinity.

It is preferred that the oiling agent contained in the fiber, which is applied to the fiber during the step of spinning or manufacturing fiber as a processing oiling agent and a finishing oiling agent, is removed from the fiber prior to or after the fiber is woven or knitted into a fabric. By this removal of the oiling agent, the content of the oiling agent in the fiber should preferably be reduced to below approximately 0.5% by weight based on the weight of the fiber. If the fiber contains more than approximately 0.5% by weight of the oiling agent, the fabric made therefrom produces noticeable amounts of tar and other similar undesirable materials on the fabric when the fabric is heated in an active gas atmosphere. Consequently, the finally obtained carbon fabric is poor in mechanical properties.

The method by which the oiling agent is removed from the fiber is not a particular one. The oiling agent may be easily removed, for example, by immersing the fiber in a solvent incapable of dissolving or swelling the fiber but capable of dissolving the oiling agent, or by dry-heating the fiber to evaporate the oiling agent.

Then, the acrylonitrile polymer fiber having a $T_f$ of at least 310° C., which may be in the form of a filament, a bundle of filaments such as tow, a filament yarn or a spun yarn, is made into a fabric, for example, a woven, knitted, braided, switched, net or corded fabric, or a nonwoven fabric such as felt, fleece, web or mat. Preferable are woven fabrics such as plain, twilled and satin fabrics, and braided, coded and stitched fabrics. The procedure by which the fiber is made into a fabric may be a conventional one.

It is essential that the fabric exhibits a free areal shrinkage of not larger than 50%, preferably not larger than 45%. By the term "free areal shrinkage" herein used is meant the areal shrinkage which is determined by measuring the original area (A) of a fabric specimen before the flame-resistant heat treatment, and the area (B) of the fabric specimen after the fabric specimen is heated under a completely relaxed condition in an active gas atmosphere and at a temperature employed in the heat treatment mentioned hereinafter. The measurement of the area B may be conveniently made by placing the fabric specimen in an oven which is filled with an active gas atmosphere and set at a desired temperature within the range of 200° to 350° C. for the heat treatment. The free areal shrinkage is calculated by the following formula:

$$\text{Free areal shrinkage (\%)} = \frac{A - B}{A} \times 100$$

The free areal shrinkage of the fabric varies depending mainly upon the shrinkage of the acrylonitrile polymer fiber used, but also upon the particular type, construction and weight per unit area of the fabric. When the fabric exhibits a free areal shrinkage of at least 50%, an undesirably large shrinkage occurs during the heat treatment. As a result of this large shrinkage, the heat treatment is carried out with difficulty, and the obtained carbon fabric is not satisfactory in its tenacity and modulus of elasticity.

Prior to the manufacture of a fabric from the fiber having a $T_f$ of at least 310° C., it is advantageous that the fiber is subjected to thermal setting pre-treatment. This is because it is easy to form a fabric from thermally set fibers and also because the finally resulting carbon fabric exhibits good mechanical properties. The thermal setting may be carried out at a temperature of 100° to 350° C., preferably 120° to 300° C., and under a tension of at least 0.01 g per denier of the fiber. The thermal setting may be carried out in the same manner as that employed in the manufacture of conventional apparel textile fibers, that is in hot air or steam, or by using a hot plate or drum. The thermal setting temperature and period should preferably be set-predetermined so that the resulting thermally set fiber has a tensile strength of at least 3.5 g/d and a shrinkage of not larger than 5%, preferably not larger than 3%. When the tensile strength of the thermally set fiber is excessively low, it is rather difficult to weave or knit the fiber into a fabric and the resultant fabric is poor in mechanical properties. Furthermore, when the shrinkage of the thermally set fiber is in excess of 5%, a fabric made from such fiber tends to exhibit an undesirably large shrinkage and the carbonized fabric is poor in mechanical properties.

Instead of thermally setting the fiber prior to manufacturing the fabric, the fabric made from the fiber may be thermally set in a similar manner. However, this procedure is not preferable as compared with the above-mentioned procedure wherein the fiber is thermally set prior to manufacturing the fabric, because, when the fabric is subjected to thermal setting, all of the fibers of the fabric are not uniformly thermally set.

The precursor fabric, which has been optionally thermally set prior to or after manufacturing the fabric, is then subjected to the flame resistant heat treatment, i.e., heated in an active gas atmosphere at a temperature of approximately 200° to 400° C., preferably 200° to 350° C. The active gas used includes, for example, air and other oxygen-containing gases, nitric oxide, sulfur dioxide and ozone.

It is essential that the above-mentioned heat treatment is effected under a condition such that shrinkage of the fabric is permitted to an extent of at least 80% of the free areal shrinkage of the fabric. When a shrinkage of less than 80% of the free areal shrinkage is permitted or when no shrinkage is permitted, adjacent fibers of the fabric tend to fuse together during the flame-resistant heat treatment; hence, the final carbon fabric is poor in flexibility. No particular method is required to carry out the shrinkage of the fabric, and conventional methods and apparatuses may be employed. For example, the fabric may be placed on a belt or a net conveyor moving in an active gas atmosphere, or hung on a series of driving rollers moving in an active gas atmosphere.

The heat treated fabric is then carbonized in an inert gas atmosphere maintained at a temperature of at least 700° C., preferably at least 800° C. The inert gas used includes, for example, nitrogen, helium or argon. It is preferable that the fabric is carbonized without applying any substantial tension thereto, although some degree of tension may be applied thereto.

The carbonization may be followed by graphitization, which is usually effected by heating the carbonized fabric at a temperature of at least 2,000° C. in an inert gas atmosphere.

The advantages of the invention may be summarized as follows. First, although the precursor fabric is heat treated while its shrinkage is permitted, the final carbon fabric exhibits a satisfactory tenacity and modulus of elasticity. Secondly, since the precursor fabric is heat treated while its shrinkage is permitted, penetration of oxygen into the inside of the fabric structure is not prevented.

Thirdly, in the case where the thermal setting or the oxidizing agent treatment is applied to the fiber or fabric, the final carbon fabric exhibits particularly improved tensile strength and Young's modulus which are approximately the same as those of a carbon fabric obtained from a conventional high tensile strength and high modulus carbon fiber. Furthermore, only a restricted type fabric can be manufactured from a conventional high tensile strength and high modulus fiber because of the rigidity of the fiber. Whereas, the carbon fabric manufactured by the process of the invention may be of any desired form such as a knitted, braided, stitched or net fabric, a nonwoven fabric, as well as a plain woven fabric, and hence, various applications for the carbon fabric are possible.

The invention will be further illustrated with reference to the following examples wherein percent (%) is by weight unless otherwise specified.

In the examples, the shrinkage of the acrylonitrile polymer fiber, the tensile strength and Young's modulus of the carbon fiber were determined as follows.

(1) Shrinkage (a) Cut a fiber specimen of a length of 50 cm and form it into a loop;
(b) Hang a weight of about 1/30 g per denier on the loop and measure the loop's initial length (A);
(c) Remove the weight and put the loop into an oven maintained at a temperature of 200° C.;
(d) Maintain the loop in a tensionless condition for 5 minutes, and;
(e) Measure the final length (B) of the loop after shrinkage under a weight 1/30 g per denier.

The shrinkage in % of the fiber is then calculated by the change between the initial and final length according to the following equation.

$$\text{Shrinkage (\%)} = \frac{A - B}{A} \times 100$$

(2) Tensile strength and Young's modulus.

A single fiber specimen extracted from a yarn of the carbon fabric is cut into a 20 mm length. The tensile test is carried out at a grip separation rate of 0.5 mm per minute. The breaking load and elongation are measured, and the tensile strength and Young's modulus are determined therefrom.

In the determination of the tensile strength and Young's modulus, when the degree of variability in denier between single fibers in the yarn of the fabric is relatively small, the cross-sectional area of each single fiber may be calculated from the weight per unit length of the yarn, the specific gravity and the number of filaments in the yarn. In contrast, when the degree of variability in denier between single fibers in the yarn is relatively large, the cross-sectional area of each single fiber may conveniently be calculated by a vibration method from the natural frequency of a single fiber specimen used for the tensile test. Furthermore, the waviness of a single fiber specimen and the elongation of the tester element particularly the load cell should be suitably corrected.

EXAMPLE 1

99.0 mol % of acrylonitrile, 0.5 mol % of 2-(1-hydroxyethyl)acrylonitrile and 0.5 mol % of sodium methallylsulfonate in a solution state were copolymerized in dimethylsulfoxide to form a copolymer having an intrinsic viscosity of 1.6. The copolymer solution was extruded into a coagulating liquid comprised of dimethylsulfoxide and water. The filaments so formed were subjected to stretching, solvent removal therefrom, drying for the densifying and, then, further stretching, to obtain filaments of 2,100 total deniers (0.7 denier per filament). The filaments contained 0.05% of the residual solvent, and had a $T_f$ of 330° C., a tensile strength of 5.0 g/d and an elongation of 14%.

A twilled fabric having a weight of 270 g/m$^2$ and a free areal shrinkage of 45% was woven from the above-mentioned filaments. The twilled fabric heated in air for approximately 150 minutes, at a temperature of from 200° to 280° C., on a net conveyor, without tension. The treated fabric was heated to 1,400° C. in a nitrogen atmosphere to obtain a carbon fabric. The fabric was pliable and easy to handle. Filaments extracted from the fabric exhibited a tensile strength of 240 kg/mm$^2$ and a Young's modulus of 23 ton/mm$^2$.

EXAMPLE 2

Acrylonitrile copolymer filaments of several types were produced, in a manner similar to that described in Example 1, from comonomer mixtures each having a composition such that methyl acrylate was substituted for a part of acrylonitrile in the comonomer mixture composition of Example 1. The amounts of methyl acrylate used and the $T_f$ of the filaments are shown in Table I, below.

Following the procedure mentioned in Example 1, carbon fabrics were manufactured from the above-mentioned filaments. The filaments extracted from the carbon fabrics exhibited the tensile strength shown in Table I, below.

TABLE I

| Run No. | Amount of methyl acrylate (mol %) | Total amount of comonomers except for AN (wt. %) | $T_f$ (°C.) | Tensile strength (kg/mm$^2$) |
|---|---|---|---|---|
| Example 1 | 0 | 2.24 | 330 | 240 |
| 2-1 | 1.0 | 3.81 | 315 | 220 |
| 2-2 | 2.0 | 5.37 | 310 | 210 |
| 2-3 | 3.0 | 6.92 | 290 | 150 |

TABLE I-continued

| Run No. | Amount of methyl acrylate (mol %) | Total amount of comonomers except for AN (wt. %) | $T_f$ (°C.) | Tensile strength (kg/mm²) |
|---|---|---|---|---|
| 2-4 | 5.0 | 9.94 | 260 | 110 |

EXAMPLE 3

Four types of filaments, each type comprised of 3,000 filaments of 2,100 total deniers, were prepared in manners similar to those described in Examples 1 and 2, wherein the proportion of methyl acrylate in the comonomer mixtures and the heat-treating conditions were varied so that the four types of filaments exhibited different shrinkages at the step of the heat treatment. The filaments had $T_f$s and shrinkages at 200° C., shown in Table II below.

Eight-shaft satin fabrics, each having a weight of 550 g/m², were woven from the above-mentioned filaments. The fabrics were subjected to a heat treatment, in air, at a temperature of 210° to 250° C., without tension. The treated fabrics were carbonized at a temperature of from 400° to 1,000° C. in a nitrogen atmosphere.

Areal shrinkages of the fabrics occurring during the heat treating step and mechanical properties of the filaments extracted from the carbonized fabrics are shown in Table II, below.

TABLE II

| Run No. | $T_f$ (°C.) | Shrinkage of filaments before weaving (%) | Areal shrinkage (%) | Carbonized filaments: Tensile strength (kg/mm²) | Carbonized filaments: Young's modulus (ton/mm²) |
|---|---|---|---|---|---|
| 1 | 270 | 17 | 75 | 140 | 20.8 |
| 2 | 325 | 13 | 58 | 183 | 21.5 |
| 3 | 330 | 8 | 44 | 226 | 23.8 |
| 4 | 330 | 2 | 39 | 251 | 24.0 |

Filament specimens of Run Nos. 1 and 2 had a low $T_f$ and a large shrinkage, and the carbonized filaments therefrom exhibited poor tensile strength. In contrast, filaments specimens of Run Nos. 3 and 4 (the invention) exhibited good tensile strength and modulus, even though they were heated without tension. It will be apparent from a comparison of Run No. 3 and Run No. 4 that, even if two types of filaments exhibit the same $T_f$, the filament which has a lower shrinkage will bring about better results than the other.

EXAMPLE 4

This Example shows the effect of thermally setting the filament, prior to the fabric-making, upon the free areal shrinkage of the fabric made therefrom and the mechanical properties of the final carbon fabric.

Following the procedure mentioned in Example 1, filaments having a total denier of 2,100 (0.7 denier per filament) were prepared from a copolymer similar to that used in Example 1. In this procedure, immediately before the final taking-up of the filaments, the filaments were heat-treated by using heated drums, maintained at a temperature of 150° to 280° C., for a period of 0 to 15 seconds (the period of "0" second means that no heat-treatment was carried out), under a tension of 0.1 to 0.2 g/d. The filaments so obtained had a $T_f$ of 330° C., and the tensile strengths and shrinkages shown in Table III below.

Eight-shafted satin fabrics, each having a density of 7 yarns/cm in both weft and warp directions, were woven from the yarn of the above-mentioned filaments. The satin fabrics were heated in air at a temperature of 220° to 240° C. without tension and, then, in a nitrogen atmosphere up to 1,400° C. to obtain a carbonized fabric. Areal shrinkage of the fabrics as heat-treated in air, and tensile strength and Young's modulus of the filaments extracted from the finally carbonized fabrics are shown in Table III below.

TABLE III

| Run No. | Filaments before weaving: Tensile strength (g/d) | Filaments before weaving: Shrinkage (%) | Areal shrinkage (%) | Carbonized filaments: Tensile strength (kg/mm²) | Carbonized filaments: Young's modulus (ton/mm²) |
|---|---|---|---|---|---|
| 1 | 6.4 | 10 | 55 | 203 | 23.5 |
| 2 | 6.3 | 8.3 | 48 | 227 | 23.7 |
| 3 | 5.9 | 4.2 | 44 | 258 | 23.8 |
| 4 | 5.4 | 2.1 | 41 | 267 | 23.5 |
| 5 | 5.2 | 0.6 | 39 | 273 | 23.2 |

It will be apparent that, when the filaments have a reduced shrinkage of lower than 5%, due to the heat-setting carried out before weaving, the resultant carbonized filaments exhibit improved mechanical properties.

EXAMPLE 5

Following the procedure used for the preparation of the heat-set filaments of Run No. 3, in Example 4, filaments of 500 total deniers (one denier per filament) were produced. A circular knitted fabric having a weight of approximately 140 g/m² was knitted from the filaments by using a circular knitting machine. The knitted fabric was heat-treated in air at a temperature of 220° to 260° C., without tension. The fabric had an areal shrinkage of 46%. The treated fabric was carbonized at a temperature of from 400° C. up to 1,400° C. in a nitrogen atmosphere. The carbonized fabric was flexible and stretchable, and easy to handle. The filaments unknitted from the carbonized fabric exhibited a tensile strength of 232 kg/mm² and a Young's modulus of 23.2 tons/mm².

EXAMPLE 6

Filaments, produced following the procedure described in Example 1 were treated with methyl ethyl ketone to extract part of the oiling agent contained in the filaments, whereby filaments having different contents of the oiling agent were prepared. Plain woven fabrics, each having a weight of 250 g/m², were woven from the filaments and carbonized in a manner similar to that described in Example 4. The $T_f$ of the filaments before being woven and areal shrinkage of the heat-treated fabrics were 330° C. and 45%, respectively, which shows that both the $T_f$ and the areal shrinkage do not depend upon the content of the oiling agent. The filaments extracted from the finally carbonized fabrics had the mechanical properties shown in Table IV, below.

TABLE IV

| Run No. | Content of oiling agent (%) | Tensile strength (kg/mm²) | Young's modulus (ton/mm²) |
|---|---|---|---|
| 1 | 2.0 | 190 | 23.7 |
| 2 | 0.8 | 203 | 23.6 |
| 3 | 0.4 | 245 | 23.8 |

TABLE 1V-continued

| Run No. | Content of oiling agent (%) | Tensile strength ($kg/mm^2$) | Young's modulus ($ton/mm^2$) |
|---|---|---|---|
| 4 | 0.2 | 267 | 23.6 |

What we claim is:

1. A process for producing a carbon fabric comprising the steps of:

subjecting an acrylonitrile polymer fiber to thermal setting treatment at a temperature of from 100° to 350° C. under a tension of at least 0.01 gram/denier in hot air or steam to obtain a fiber having a fusing temperature of at least 310° C., a shrinkage of not larger than 5 percent and a tensile strength of at least 3.5 grams/denier, weaving or knitting the thermally set fiber into a woven or knitted fabric exhibiting a free areal shrinkage of not more than 50 percent, and then, heating for stabilization of the fabric in an active gas atmosphere maintained at a temperature of from 200° to 350° C. under conditions such that the fabric is permitted to shrink by at least 80 percent of the free areal shrinkage, said active gas being selected from the group consisting of air and other oxygen-containing gases, nitric oxide, ozone and sulphur dioxide, and carbonizing the heat-stabilized fabric in an inactive gas atmosphere.

2. A process according to claim 1 wherein the acrylonitrile polymer fiber is made of an acrylonitrile polymer comprised of at least 94 percent by weight of acrylonitrile and not more than 6 percent by weight of at least one other copolymerizable mono-ethylenically unsaturated monomer.

3. A process according to claim 7 wherein the acrylonitrile polymer fiber has an intrinsic viscosity of from 1.4 to 2.3, as measured at 25° C. on a 150 mg/50 ml polymer solution in dimethylformamide.

4. A process according to claim 1 wherein, prior to the thermal setting treatment of the acrylonitrile polymer fiber, the fiber is stretched at least 6 times the original length of the fiber.

5. A process according to claim 1 wherein the thermal setting treatment of the acrylonitrile polymer fiber is carried out at a temperature of from 120° to 300° C.

6. A process according to claim 16 wherein the thermally set fiber contains not more than approximately 0.1 percent by weight of residual solvent based on the dry weight of the fiber.

7. A process according to claim 1 wherein the thermally set fiber has a shrinkage of not larger than 3 percent.

8. A process according to claim 16 wherein the fabric to be heated for stabilization contains not more than 0.5 percent by weight of an oiling agent applied during the fiber-manufacturing step.

9. A process according to claim 1 wherein the inactive gas is selected from the group consisting of nitrogen, helium and argon.

10. A process according to claim 1 wherein the inactive gas atmosphere is maintained at a temperature of at least 700° C.

* * * * *